United States Patent [19]

Dudley

[11] 4,216,865

[45] Aug. 12, 1980

[54] WHOLE FRUIT SIZE GRADER

[76] Inventor: Robert G. Dudley, c/o Dudley Machinery Company P.O. Box 3038, Montery, Calif. 93940

[21] Appl. No.: 915,757

[22] Filed: Jun. 15, 1978

[51] Int. Cl.[2] ..... B07C 5/12

[52] U.S. Cl. ..... 209/539; 209/682; 209/921; 209/911

[58] Field of Search ..... 209/682, 921, 911, 934, 209/539, 920

[56] References Cited

U.S. PATENT DOCUMENTS

| | | | |
|---|---|---|---|
| 1,731,115 | 10/1929 | Taylor | 209/682 X |
| 3,251,466 | 5/1966 | Flieshman | 209/682 |
| 4,075,087 | 2/1978 | Gerrans | 209/921 X |

*Primary Examiner*—Allen N. Knowles
*Attorney, Agent, or Firm*—George F. Lee

[57] ABSTRACT

A whole fruit size grader comprising a horizontally oscillating table having a generally horizontal flat area on which fruit to be sized is loaded and a sorting area which slopes therefrom downwardly to a prime size fruit collecting area or station. Said sloped sorting area embodies closely spaced side-by-side troughs extending in the direction of the table oscillation. These troughs communicate at their upper ends with the loading area to receive the fruit in response to table oscillation, have oppositely sloped side walls for guiding the fruit to the lower discharge end thereof, and have tapered discharge openings upstream of their lower discharge ends for separating the undersize fruit from the prime size fruit and have associate means in the form of horizontal fins over said discharge openings which retard the fruit as it moves over said discharge openings to influence the separate collection of the undersize fruit.

6 Claims, 4 Drawing Figures

WHOLE FRUIT SIZE GRADER

This invention relates to a whole fruit size-grading apparatus and particularly to a novel and improved oscillating table for sorting fruit such as oranges, apricots and the like for collection according to size. It could also be used to size grade or sort other produce such as cucumbers, pears, peppers and the like.

In accordance with this invention such a sorting table has a generally flat solid imperforate surface at one end onto which is loaded fruit to be sorted as to size. Communicating with said loading area and sloping downwardly therefrom is a sorting area embodying a smooth imperforate corrugated surface constituting a plurality of closely spaced side-by-side grooves, channels or troughs which extend generally in the direction of table oscillation and communicate at their lower end with a collection area.

In accordance with the invention, these troughs are provided with tapered slots or openings upstream of the discharge ends thereof through which undersize fruit can discharge to a collecting area separate from the collecting area into which the larger size fruit discharge.

A feature of the invention is that the troughs are so structured as to receive the fruit from the loading area, guide the prime size fruit to the discharge end of the table while directing undersize fruit through the corresponding discharge openings in the troughs ahead of the trough discharge ends.

In its preferred form said troughs have means associated therewith to retard the gravital flow of the fruit in said troughs across said undersize fruit discharge openings to facilitate the sorting of the fruit.

Another feature of the invention is that the sorter table including both its horizontal flat loading area and its downward sloped sorting area comprise a one piece smooth surfaced solid imperforate plastic member which facilitates its function of sorting the fruit according to size while minimizing possible injury or brusing of the fruit and at the same time being readily cleaned and sanitized.

Other features and/or advantages of the invention will be at once apparent, or will become so, upon consideration of the presently preferred embodiment of the invention which now will be described.

Referring therefor to the accompanying drawings wherein like parts are identified by like reference numerals:

Figure 1:
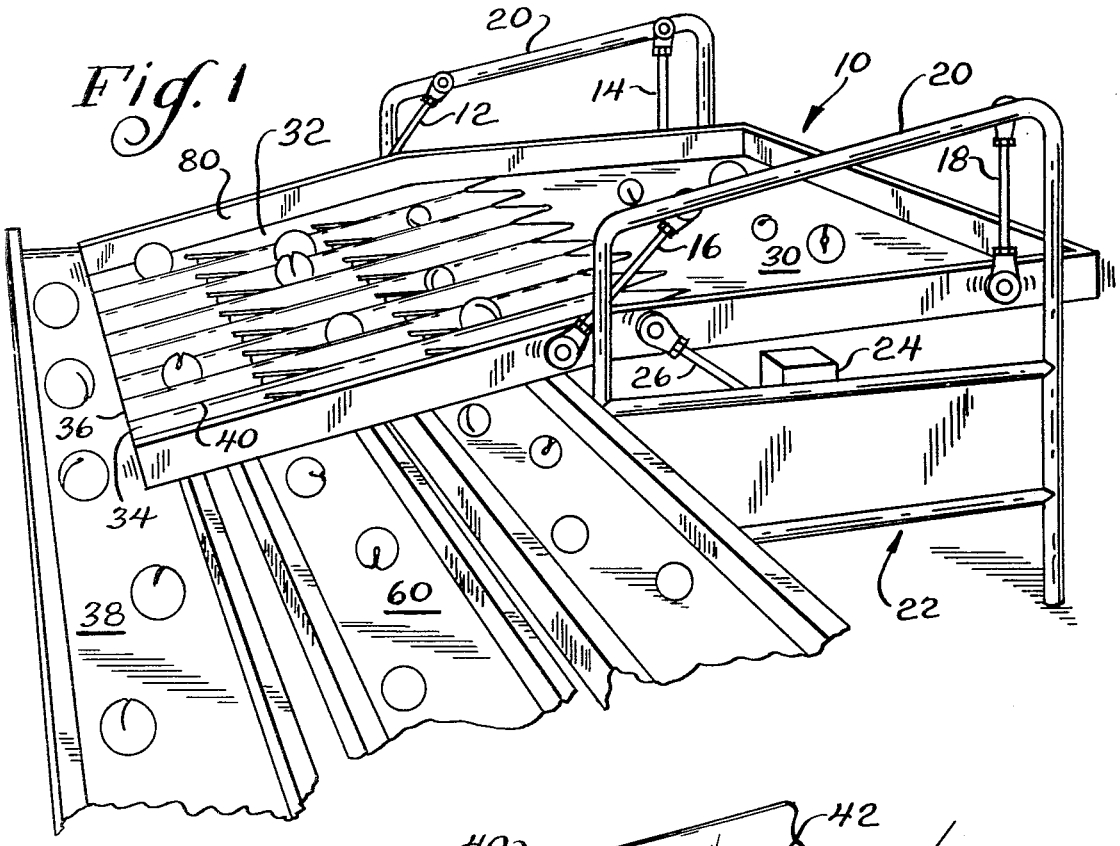
FIG. 1 is a perspective view of a whole fruit size-grading apparatus including a sorting table according to the invention.

Now referring more specifically to FIG. 1, said view illustrates at 10 a one piece generally rectangularly-shaped sorting table or platform constructed in accordance with the invention. Table 10 is shown pivotally connected adjacent its four corners to links 12–18 which in turn are pivotally suspended from a pair of parallel spaced tubular standards 20 of a supporting frame 22 so that table 10 is free to be oscillated horizontally with a small vertical displacement in a fore and aft direction between and parallel to said standards 22. At 24 is a motor drivingly connected by link 26 to sorting table 20 to effect oscillation of the table through a generally horizontal plane and in the direction confined by said links 12–18.

In accordance with this invention, sorting table 10 comprises a generally horizontal flat loading area 30 on which whole fruit such as apricots, oranges, lemons and other generally ball shaped fruit is loaded for size grading or sorting. Communicating with said loading area 30 is a downwardly sloped corrugated sorting area 32. Said corrugated sorting area 32 thus comprises a series of closely shaped side-by-side troughs, channels or grooves 34 which extend from the loading area 30 generally in the direction of oscillation of the table, downwardly to a belt 38 which collects fruit discharging from the lower end 36 of said troughs.

Figure 2:
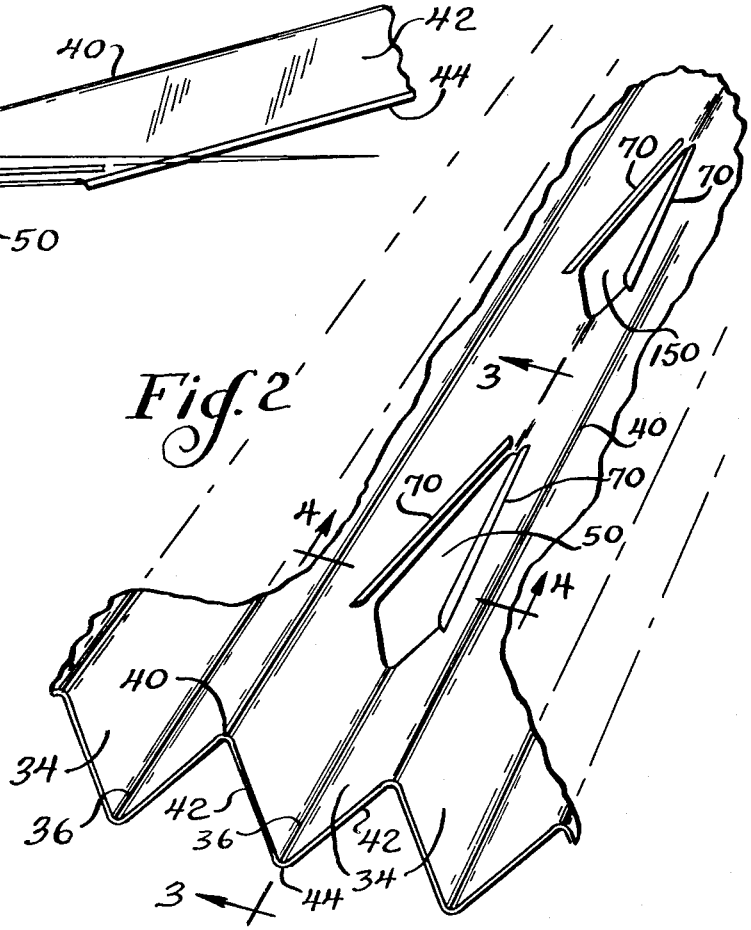
FIG. 2 is an enlarged fragmented top plan view of the troughs comprising the sorting area of said table in accordance with the invention.

Considering also FIG. 2 with FIG. 1 it will be seen that these troughs 32 are separated by narrow ridges 40 and have inwardly and downwardly sloping opposed side walls 42 which merge into a narrow rounded narrow base 44. Said troughs 34 have a width which is substantially less than the sizes of fruit to be sorted by oscillation of the table 10, a depth at least that of the prime size fruit and a width in the plane of the separating ridges which is greater than the diameter of said prime size fruit. Also, as seen best in FIG. 1, the base and sloping side walls of these troughs 34 and the separating ridges 40 at their upper end gradually merge into the flat surface of the fruit loading area of the table. So that with oscillation of the table 10 in response to operation of motor 24, fruit loaded thereon is slowly directed toward the upper ends of the trough 32 into which they align themselves, one behind the other, and descend down the troughs 34 between the ridges 40 toward their discharge end 36. In the presently preferred embodiment of the invention, table 10 although previously described as generally horizontal preferably is disposed at some small angle of declination from true horizontal, for example one degree. Also, said sorting area 32 is disposed at a declination angle of approximately 15° from horizontal.

Referring now particularly to FIG. 2, intermediate the lower discharge end and upper receiving end of each said troughs 34 there are provided openings 50 through which undersized fruit discharges ahead of the discharge end 36 of the troughs. In accordance with this invention said discharge openings 50 are both tapered and elongated in the direction of table oscillation, thus having an axial length several times that of the diameter of the prime size fruit and a width at their downstream end which approaches that of, but is less than, the diameter of what is considered the minimum diameter of prime size fruit. The opposed side edges of said discharge openings 50 taper rearwardly to a width at their upstream end which is less than the expected diametric size of fruit to be loaded on the loading area 30. It will be appreciated therefore that as the fruit enter the troughs 34 from the loading area 30 they are guided downwardly toward the discharge end of the troughs 36 under the pull of gravity and the prime size fruit is guided by the sloping side walls of said troughs over said discharge openings 50 to belts 38. Smaller size fruit, however, will be engaged and therefore guided by the opposed side edges of the discharge openings 50 which extend into the side walls of the trough (FIGS. 3 and 4) toward the larger end of the openings 50 dropping therethrough as they reach that portion of the discharge opening having a width as great as or greater than the fruit diameter. The undersized fruit dropping through discharge openings 50 is caught and collected by belt 60 which is appropriately located for this purpose. It will be understood that the collecting belts 38 and 60 are so located and have a width related to the horizontal stroke of the oscillation of the table 10 such that belt 38 remains in continuous communication with the discharge end of the troughs and belt 60 remains continuously in communication with discharge aperture 50.

Figure 3:
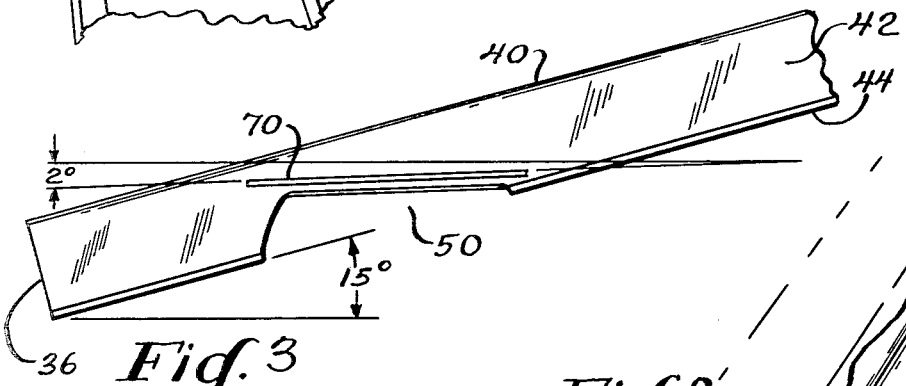
FIG. 3 is a sectional view taken lengthwise of one of the troughs comprising the sorting area of said table the view being taken along line 3—3 of FIG. 2 looking in the direction indicated by the arrows.
Figure 4:
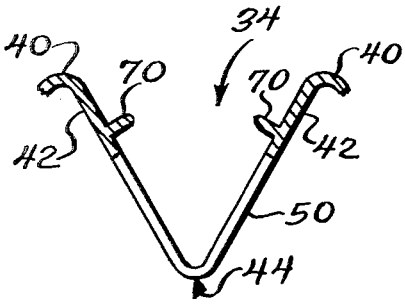
FIG. 4 is a cross sectional view taken along lines 4—4 of FIG. 2 also looking in the direction indicated by the arrows.

Referring still to FIG. 2, and also considering FIGS. 3 and 4 therewith, the invention also includes retarding means to slow down the fruit as it is directed by the sloping sidewalls of the trough across the discharge openings 50, thereby to provide greater opportunity for undersize fruit to drop through the discharge opening 50 rather than continue to the discharge end of the trough. Such means is illustrated in said FIGS. 2, 3 and 4 as comprising a pair of generally horizontally disposed lips or fins 70 which are spaced over said discharge aperture 50 and arranged along the full length thereof. These inner edges are illustrated spaced apart a distance corresponding to the progressively tapering width of the discharge apertures 50 themselves. As illustrated by FIG. 4 with FIG. 3, said lips 70 present a generally horizontal track or one at some slight declination, for example 2° from true horizontal, along which the fruit moves over the discharge openings 50. Being disposed generally horizontal they slow down or retard the gravital pull of the fruit across the openings 50 so that there is more time for the smaller size fruit to be caught and discharge through said openings 50 to belt 60.

It will be understood of course that the troughs 34 may be provided each with more than one discharge opening 50 so that the table may be utilized to sort the fruit into any required number of sizes. Thus in FIG. 1 a second discharge opening is illustrated at 150 which is generally arranged and shaped as is aperture 50 and is also provided with overlying lips 70 which retard movement of fruit thereacross. As illustrated the widest lateral dimension of opening 150 is substantially less than the widest dimension of the downstream discharge opening 50 wherefore it is adapted to receive one size of fruit while rejecting larger sizes, the latter then proceeding by gravitation down the troughs to the next discharge end of the trough.

In accordance with the invention, sorting table 10 including its flat horizontally disposed loading area 30 and its downwardly sloped sorting area 32 including troughs 34 and the fruit movement retarding lips 70 are moulded into a one piece unit of suitable plastic material such as fiber reinforced polyester resin sometimes referred to as fiberglass and characterized by smooth solid imperforate surfaces and rounded edges about the discharge openings 50 and 150 as well as along the edges of the fins 70. Preferably also, as illustrated in FIG. 1, the sorting table 10 is enclosed by a three-sided frame or ledge 80 (only the discharge end thereof being left open) and this ledge comprises an integral part of the moulded table 10. The sorting table is therefore readily cleaned and sanitized. Fruit is confined on the table by said ledge 80 and is also capable of flowing from the loading area onto the troughs of the sorting area in reponse to oscillation of the table and so as to be guided by the sloping side walls and/or edges of the discharge openings 150 and their associated fruit-movement-retarding lips or fins 70 to the respective discharge areas without bruising or being injured.

The structure is simple but effective in its operation and economical to manufacture.

Thus having described the invention I claim:

1. In a whole fruit size grader, a generally horizontally oscillated sorting table having a generally horizontal flat loading area on which fruit to be size-graded is loaded and a downwardly sloped sorting area having an upper corrugated surface across its width defining a series of side-by-side close related troughs extending in the direction of said oscillation, each said troughs having inwardly-sloped spaced side walls which guide the fruit downwardly toward the lower discharge end of the troughs, the side walls and base of said troughs at their upper end merging into the generally horizontal flat surface of the loading area of the sorting table to receive said fruit therefrom as the table is oscillated, each said troughs having at least one discharge opening upstream of their lower end, said discharge opening having a generally tapered shape of a width through which full size fruit cannot pass, the narrow end of said tapered discharge opening being located upstream so as to engage and direct undersized fruit for discharge through the downstream wider end of said opening, and having means arranged over said discharge opening of the troughs to slow down the movement of the fruit over said undersized fruit discharge openings.

2. The sorting table of a whole fruit size grader as claimed in claim 1 wherein said fruit movement retarding means includes a pair of horizontally disposed lips spaced above and on opposed sides of said discharge openings.

3. The sorting table of claim 2 wherein said lips are co-planar and define a tapered space therebetween of a width and length corresponding to that of the discharge opening with which it is associated.

4. The sorting table of a whole fruit grader as claimed in claim 3 wherein each said troughs have a further undersized fruit discharge opening upstream of the first discharge opening, said further opening being of similar shape and disposition but of lesser width than the first mentioned discharge opening.

5. The sorting table of a whole fruit grader as claimed in claim 1 wherein the table is a one-piece molded structure which is readily sanitized.

6. The sorting table of claim 5 wherein its loading and sorting areas have a smooth solid imperforate surface.

* * * * *